US005291741A

United States Patent [19]

Grimes

[11] Patent Number: 5,291,741

[45] Date of Patent: Mar. 8, 1994

[54] LIQUID HELIUM TOPPING-UP APPARATUS

[75] Inventor: David A. Grimes, Marcham, England

[73] Assignee: Oxford Magnet Technology Limited, Middlesex, United Kingdom

[21] Appl. No.: 957,557

[22] Filed: Oct. 8, 1992

[30] Foreign Application Priority Data

Feb. 5, 1992 [GB] United Kingdom ..... 9202399

[51] Int. Cl.[5] ..... F17C 7/02

[52] U.S. Cl. ..... 62/51.3; 62/50.7

[58] Field of Search ..... 62/50.1, 50.7, 51.3

[56] References Cited

U.S. PATENT DOCUMENTS 3,345,827 10/1967 Karbosky ..... 62/50.1
3,850,004 11/1974 Vander Arend ..... 62/51.3
4,611,623 9/1986 Goodrich ..... 62/50.7
4,744,222 5/1988 Murai ..... 62/50.1
4,872,314 10/1989 Asano et al. ..... 62/50.1

*Primary Examiner*—Ronald C. Capossela
*Attorney, Agent, or Firm*—Keck, Mahin & Cate

[57] ABSTRACT

To ensure that only liquid helium is delivered to a cryostat dureing liquid helium refill, the arrangement automatically diverts hot gas which is produced during cooling of the transfer tube, away from the cryostat. The arrangement comprises a three way valve which is operated by pressure variations as a result of cooling part of an enclosed volume of helium gas to a temperature near the normal boiling point of the liquid at atmospheric pressure. The arrangement provides the advantage in that the transfer of helium to a cryostat now becomes very much a less skilled operation.

11 Claims, 3 Drawing Sheets

LIQUID HELIUM TOPPING-UP APPARATUS

This invention relates to apparatus for topping-up liquid helium used in cryogenic vessels such as superconducting cryogenic magnets.

Superconducting cryogenic magnets comprise a superconducting winding which is maintained at a temperature close to absolute zero by means of liquid helium which has a low latent heat of vaporisation at its boiling point of 4.2 K. at normal atmospheric pressure. When topping-up such magnets whilst they are operational, liquid helium and cold helium vapor (i.e. 4.2 K.) only should be delivered.

If hot helium gas is blown onto or comes into thermal contact with parts of a superconducting magnet, it can cause the magnet windings to be heated above the temperature at which they can remain superconducting. If this happens, the magnet will quench and the energy of the magnet will be transferred into the liquid helium and evaporate the liquid. The quantity of liquid evaporated depends upon the stored energy of the magnets and can be very large for a large magnet.

In order to effectively transfer liquid helium between vessels it is well known to use a transfer tube (syphon) comprising inner and outer concentric tubes wherein the space between the tubes is evacuated to a hard vacuum and possibly contains heat reflecting material. The inner tube is supported in a heat isolating way from the outer tube and liquid helium is passed through the inner tube. This construction and method ensures minimum heat input to the liquid helium in the transfer tube, and thereby maximises the fraction of liquid fed to the receiving vessel. Moreover, it is also well known that the helium transfer tube should be cooled so that liquid is being delivered, before the delivery end of the transfer tube is inserted into a vessel containing liquid helium or into a cryostat containing a magnet which is at field (i.e. operational).

With known arrangements, a further problem arises when a supply vessel from which liquid helium is being transferred to a magnet becomes empty, since warming gas will start to be transferred through the transfer tube instead of cold liquid. If this is allowed to continue for some time, which depends upon the size and length of the transfer tube, hot gas will eventually be transferred into the cryostat and this can cause the magnet to quench. It is therefore necessary with this known arrangement for an operator to monitor the transfer carefully and to stop the transfer as soon as the supply vessels empties.

In superconducting magnet systems, it is sometime desirable to fit part of the helium transfer tube permanently to the cryostat. This has the advantage that a cryostat can be filled whilst operating at floor level and reduces the clearance required for operating above the cryostat. However, a disadvantage of the transfer tube being fitted to the cryostat is that it is then no longer possible to cool the transfer tube to liquid delivery temperature before it is inserted, and alternative means must be provided to prevent hot gas being transferred. One known method of ensuring that the transfer tube is cooled is to maintain the cryostat at a pressure slightly above atmospheric pressure by means of a suitable relief valve so that cold gas from the cryostat can be forced backwards along a fixed part of the transfer tube until it is seen that very cold gas, at nearly 4.2 K., blows from the free end; the other part of the transfer tube having also been cooled to liquid delivery temperature is then coupled to the fixed part so that liquid can be transferred into the cryostat.

Problems can be encountered with ensuring that the fixed part of the syphon is fully cooled. If the pressurising relief valve is not operating correctly or if there is a gas leak there may not be sufficient pressure in the cryostat to cool the transfer tube fully. Additionally the procedure is quite complicated and requires a skilled operator to perform it correctly, thus if the emptying of the supply vessel occurs un-noticed by the operator, hot gas could be transferred which could cause a quench.

It is an object of the present invention to provide apparatus for topping-up the liquid helium in a superconducting cryogenic magnet during operation, which is simple is use, and which obviates the risk of a quench occurring.

According to the present invention apparatus for topping-up a cryogenic vessel with liquid helium comprises a thermally insulated transfer tube for the transfer of liquid helium from a storage dewar to the cryogenic vessel, thermally insulated valve means via which the transfer tube is arranged to communicate with the said vessel, and a temperature sensitive valve actuator having a sensor element positioned within the transfer tube at an end region thereof adjacent the cryogenic vessel, to which actuator the valve is responsive for diverting helium gas away from the said vessel when the gas is above a predetermined temperature as sensed by the temperature sensor element.

By positioning the temperature sensor element in the transfer tube adjacent the cryogenic vessel, admission to the vessel via the valve of warm helium gas which might initiate a quench is automatically precluded.

The temperature sensitive valve actuator may comprise a gas reservoir having two chambers spaced apart and arranged in mutual communication, one of the said chambers being of fixed volume and defining the sensor element and the other of the said chambers being positioned so as to be at ambient temperature and being volumetrically variable in accordance with the temperature of gas in the said one chamber which defines the sensor element, thereby to effect valve operation for helium gas diversion purposes when the temperature of the sensor element exceeds the said predetermined temperature.

The gas reservoir may contain helium.

The said one chamber may comprise a rigid tube closed at one end to which end valve obturator means is secured, the rigid tube being arranged to communicate with and to be secured to the volumetrically variable chamber at the other end of the tube remote from the said closed end, whereby the valve obturator means is constrained to move for gas diversion purposes as the chamber changes volumetrically when the temperature of the sensor element exceeds the said predetermined temperature.

The volumetrically variable chamber may comprise a bellows. The bellows may be arranged to expand consequent upon a temperature rise within a predetermined range as sensed by the sensor element thereby to effect valve operation against the biasing force of a spring.

The spring may be a helical coil spring.

The bellows may embody a stop member which serves to limit compression of the bellows by the spring.

The rigid tube may be adapted and arranged to serve as a connecting rod having secured at one end thereof a valve obturator which co-operates with a valve seat to close the transfer tube so as to prevent helium gas entering the vessel, and a valve slider which operates contemporaneously with the valve obturator to divert helium gas through an exhaust port when the valve obturator is closed against the valve seat.

The valve means and the transfer tube may be thermally insulated by insulator means including an evacuated enclosure which enclosure is arranged effectively to surround the valve means and the transfer tube.

Some embodiments of the invention will now be described by way of example only with reference to the accompanying drawings, in which.

Figure 1:
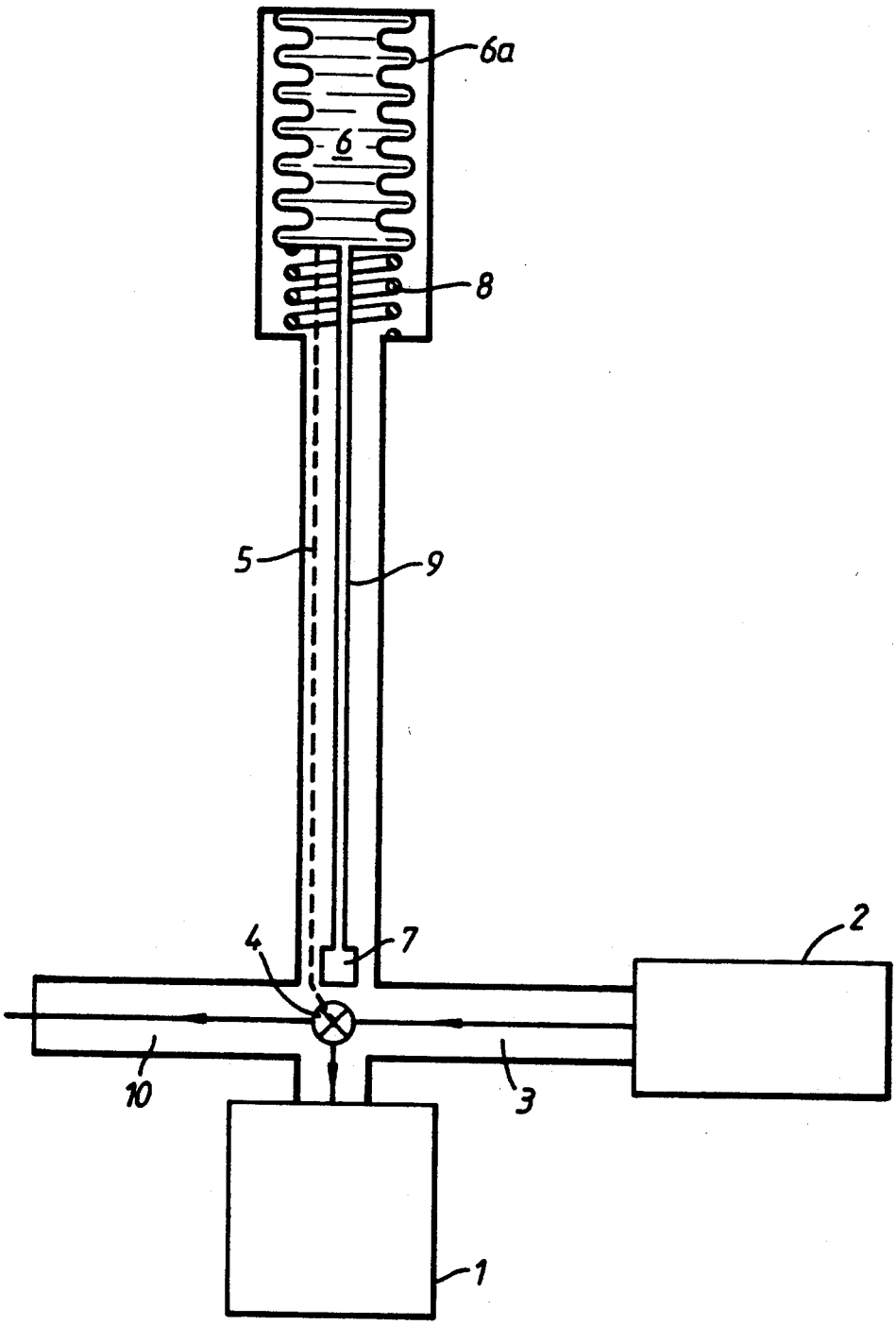
FIG. 1 is a somewhat schematic sectional view of apparatus for topping-up a cryogenic vessel.

Referring now to FIG. 1, apparatus for topping-up a cryogenic vessel 1 with liquid helium from a liquid helium storage dewar 2, comprises a vacuum enclosed helium transfer tube 3 which is arranged to supply liquid helium to the cryogenic vessel 1 via a valve arrangement 4 (shown schematically). The valve arrangement 4 is operated by a temperature sensitive valve actuator which comprises a actuating link, represented in FIG. 1 by the broken line 5, and a two chamber gas reservoir filled with helium, defined by a room temperature gas chamber 6 which is in communication with a temperature sensing chamber 7. The room temperature gas chamber 6 and the temperature sensing chamber 7 are coupled for mutual communication by means of a rigid tube 9 which might conveniently serve as the actuating link 5. The temperature sensing chamber 7 is volumetrically fixed whilst in contradistinction the room temperature gas chamber 6 is defined by a bellows 6*a* which is volumetrically variable and held in compression by a coil spring 8. In operation of the arrangement, when delivery of gas from the liquid helium storage dewar 2 to the cryogenic vessel 1 begins, relatively hot gas flows initially which is diverted by the valve arrangement 4 to be exhausted via an exhaust tube 10. When the transfer tube 3 has cooled sufficiently so that liquid helium or helium gas at 4.2 K. is present in the region of the temperature sensing chamber 7, the valve arrangement 4 is constrained to operate so that the exhaust tube 10 is closed off and contemporaneously the cryogenic vessel is accessed via the valve arrangement 4 to permit delivery of liquid helium and/or helium gas at an acceptable temperature.

The temperature at which the valve arrangement 4 operates is determined in dependence upon the pressure of gas in the gas reservoir as defined by the room temperature gas chamber 6 and the temperature sensing chamber 7 in combination. When the cryogenic vessel is a superconducting cryogenic magnet it is desired that the valve should operate at a temperature near to 4.2 K. and that the operation should occur over a small range of temperature. To this end it is necessary that the pressure in the gas reservoir should reduce suddenly as the temperature approaches 4.2 K. and the gas condenses thereby to effect rapid operation of the valve arrangement 4. It has been found that a ratio of the nominal mean volume of the room temperature gas chamber 6 to the volume of the temperature sensing chamber 7 should be about 50 or greater to produce a rapid valve switching operation at or about 4.2 K. It will be appreciated that the room temperature gas chamber, changes in volume as valve operation occurs and for the purpose of calculating the volumetric ratio just before mentioned a mean volume between operational states is assumed.

In the present example a volumetric change produced when the temperature sensing chamber is at about 4.2 K. is arranged to produce contraction of the room temperature gas chamber 6 with some assistance from the spring 8, which contraction is used to operate the valve arrangement 4. In principle, however, it will appreciated that alternative arrangements might be envisaged wherein a volumetric change is used in other ways to operate the valve arrangement 4. For example, a pressure sensitive element may be arranged to form a part of the temperature sensing chamber 7 which pressure sensitive element may be used to effect valve operation.

Figure 2:
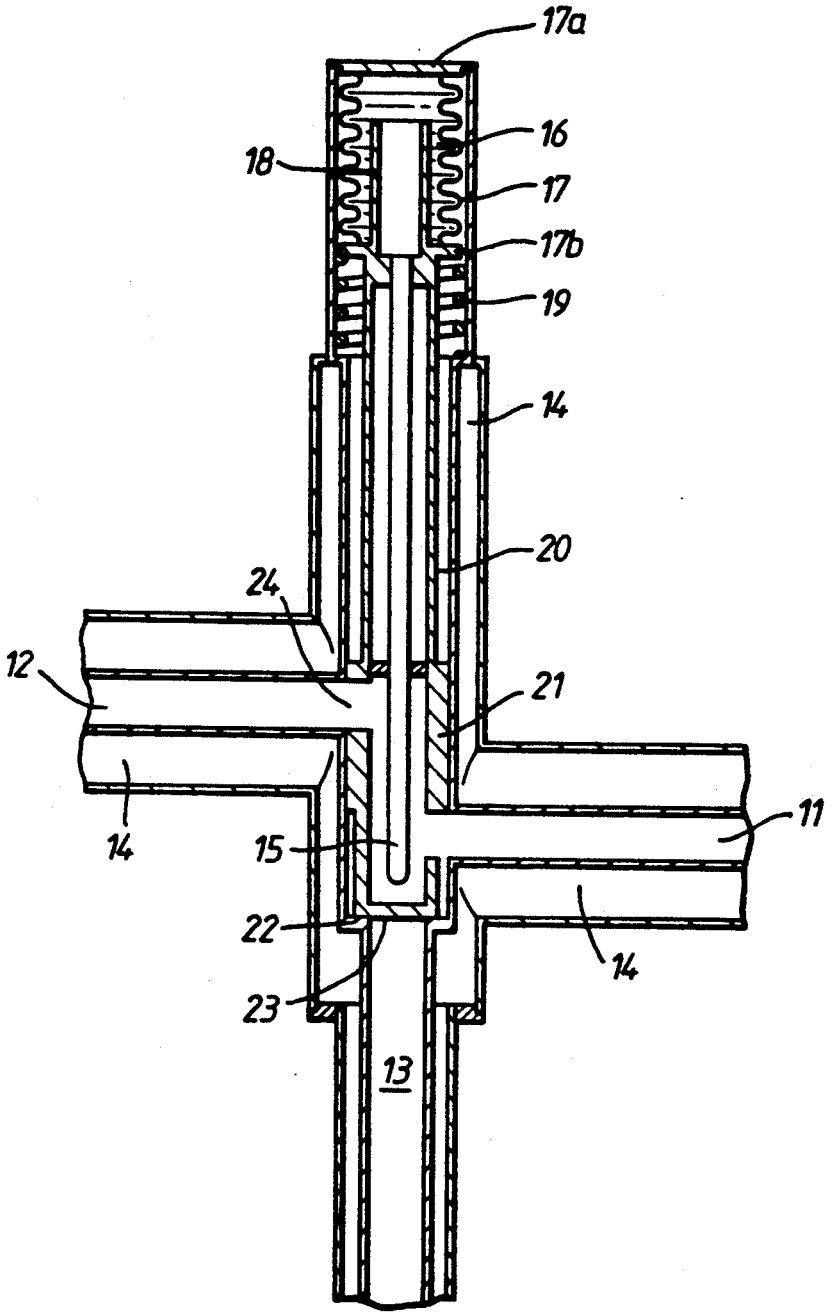
FIG. 2 is a sectional view of an apparatus for topping-up a cryogenic vessel in accordance with one embodiment of the invention.

One embodiment of the invention as shown in FIG. 2, comprises a liquid helium inlet pipe 1 1, a hot gas outlet pipe 12 and a liquid helium delivery pipe 13 which is coupled to a cryostat not shown. The parts 11, 12 and 13 are surrounded by an evacuated space 14. A temperature sensing chamber defined by a tube 15 is coupled to a room temperature chamber 16 comprising a bellows 17 sealed between two end flanges 17*a* and 17*b*. The flange 17*b* is arranged to carry a limiting stop 18 which consequent upon predetermined compression of the bellows 17 abuts the flange 17*a* thereby to limit further compression of the bellows. Although the bellows 17 will expand or contract as the pressure of gas contained therein changes, a coil spring 19 is provided which serves to compress the bellows although it will be appreciated that provision of this spring is not essential. A tube 20 is secured to the flange 17*b*, the tube 20 having attached to it a valve slider 21.

In operation of the arrangement when the temperature of the gas in the tube 15 is high, i.e. well above 4.2 K., gas pressure within the tube 15 and the chamber 16 is also high (e.g. about 15 bar at room temperature) whereby the bellows 17 is expanded against the biasing force of the spring 19 so that the slider 21 is pushed downwardly against a valve seat 22 thereby to close a valve port 23 which communicates with a cryogenic vessel (not shown) via the delivery pipe 13. Contemporaneously with closure of the valve port 23, a valve port 24 is opened so that relatively hot helium gas fed from a liquid helium storage dewar (not shown) via the liquid inlet pipe 11 can be exhausted through the gas hot outlet pipe 12. Conversely when gas in the tube 15 has cooled to about 4.2 K. the pressure in the chamber 16 falls whereby the bellows can be compressed by the spring 19. This lifts the slider 21 such that the valve port 23 is opened and the valve port 24 is closed whereby liquid helium and/or helium gas at 4.2 K. is supplied to the cryogenic vessel (not shown). The tubes and pipes used in the arrangements may be made of stainless steel, for example, which is a relatively good insulator and tubes or pipes carrying helium from the liquid helium storage dewar would normally be very well insulated and silvered as well as being contained within the vacuum space 14.

Figure 3:
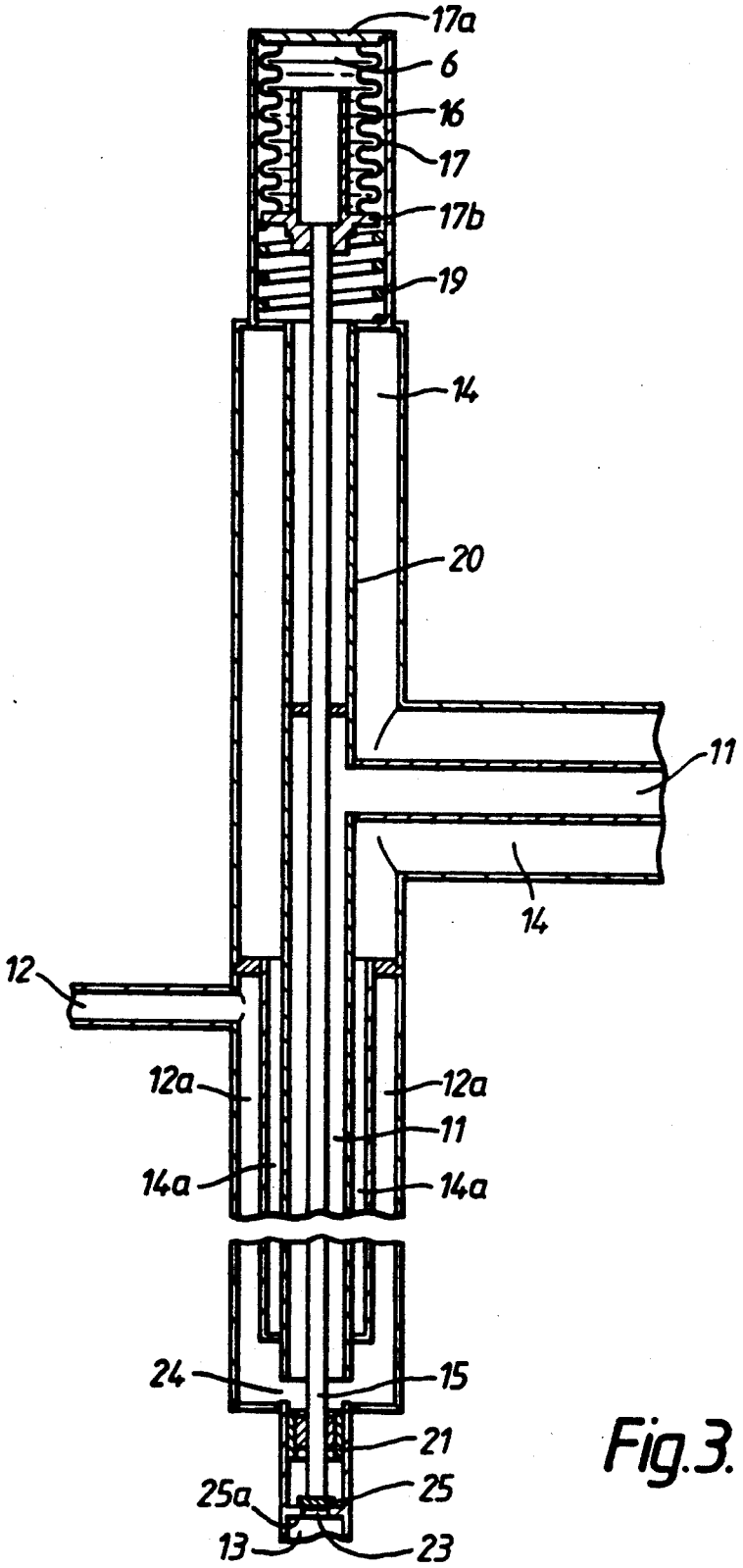
FIG. 3 is sectional view of apparatus for topping-up a cryogenic vessel in accordance with an alternative embodiment of the invention.

Various modifications may be made to the arrangement shown in FIG. 3 and for example the tube 25 could be made sufficiently strong so that it could be used to operate the valve slider without the need for the tube 20. It will also be appreciated that if the bellows 17 is extended beyond its free length when pressurised it may be used to provide a force whereby the spring 19 could be eliminated.

An alternative embodiment of the invention will now be described with reference to FIG. 3, wherein parts corresponding to those shown in FIG. 2 bear the same numerical designations. It can be seen that although the arrangement of FIG. 3 is generally similar to FIG. 2, the tube 15 has secured to one end a valve obturator member 25 which in operation closes against a valve seat 25*a* to shut off the delivery passage 13. Additionally, it can be seen from FIG. 3 that relatively hot gas exhausted through the outlet pipe 12 are fed thereto via the valve port 24 along an annular pipe 12*a* which surrounds an annular portion 14*a* of the evacuated space 14 whereby improved insulation is afforded in a region adjacent to the valve port 23. It is evident that alterative arrangements may be fabricated to achieve a similar effect. For example, the outlet exhaust pipe 20 could be vented in an alterative manner at a location which is at lower temperature and more remote from the delivery tube 13.

It will be appreciated that the various embodiments of the invention hereinbefore described afford the very special advantage that a topping-up procedure for a cryogenic vessel is facilitated to ensure that only very cold gas or liquid is delivered during the topping-up procedure. Although the apparatus hereinbefore described finds application more especially for the topping-up of liquid helium in superconducting cryogenic magnets it will be appreciated that apparatus according to the invention may be advantageously used for topping-up any cryogenic vessel.

I claim:

1. Apparatus for adding liquid helium to a cryogenic vessel comprising:

a cryogenic vessel, a thermally insulated transfer tube for the transfer of liquid helium from a storage dewar to the cryogenic vessel, thermally insulated valve means via which the transfer tube is arranged to communicate with the said vessel, and a temperature sensitive valve actuator having a temperature sensor element positioned within the transfer tube at an end region thereof adjacent the cryogenic vessel, to which actuator the valve means is responsive for diverting helium gas away from the said vessel when the gas is above a predetermined temperature as sensed by the temperature sensor element, and means for diverting helium gas away from the said vessel.

2. Apparatus as claimed in claim 1, wherein the temperature sensitive valve actuator comprises a gas reservoir having two chambers spaced apart and arranged in mutual communication, one of the said chambers being of fixed volume and defining the sensor element and the other of the said chambers being positioned so as to be at ambient temperature and being volumetrically variable in accordance with the temperature of gas in the said one chamber which defines the sensor element, thereby to effect valve operation for helium gas diversion purposes when the temperature of the sensor element exceeds the said predetermined temperature.

3. Apparatus as claimed in claim 2, wherein the gas reservoir contains helium.

4. Apparatus as claimed in claim 3, wherein the said one chamber comprises a rigid tube closed at one end to which end valve obturator means is secured, the rigid tube being arranged to communicate with and to be secured to the volumetrically variable chamber at the other end of the tube remote from the said closed end, whereby the valve obturator means is constrained to move for gas diversion purposes as the chamber changes volumetrically when the temperature of the sensor element exceeds the said predetermined temperature.

5. Apparatus as claimed in claim 4, wherein the volumetrically variable chamber comprises a bellows.

6. Apparatus as claimed in claim 5, wherein the bellows is arranged to expand consequent upon a temperature rise within a predetermined range as sensed by the sensor element thereby to effect valve operation against the biasing force of a spring.

7. Apparatus as claimed in claim 6, wherein the spring is a helical coil spring.

8. Apparatus as claimed in claim 7, wherein the bellows embodies a stop member which serves to limit compression of the bellows by the spring.

9. Apparatus as claimed in claim 8, wherein the rigid tube is adapted and arranged to serve as a connecting rod having secured at one end thereof a valve obturator which co-operates with a valve seat to close the transfer tube so as to prevent helium gas entering the vessel, and a valve slider which operates contemporaneously with the valve obturator to divert helium gas through an exhaust port when the valve obturator is closed against the valve seat.

10. Apparatus as claimed in claim 9, wherein the valve means and the transfer tube are thermally insulated by insulator means including an evacuated enclosure which enclosure is arranged effectively to surround the valve means and the transfer tube.

11. Apparatus as claimed in claim 1, wherein the valve means is adapted to operate rapidly over a narrow temperature range at about 4.2 K.

* * * * *

UNITED STATES PATENT AND TRADEMARK OFFICE

CERTIFICATE OF CORRECTION

PATENT NO.: 5,291,741
DATED : March 8, 1994
INVENTOR(S): David A. Grime

It is certified that error appears in the above-identified patent and that said Letters Patent is hereby corrected as shown below:

On the Title Page, at [75], the correct spelling of the inventor's name is --Grime--.

Signed and Sealed this

Twenty-eighth Day of June, 1994

*Attest:*

Bruce Lehman

BRUCE LEHMAN

*Attesting Officer*

*Commissioner of Patents and Trademarks*